US005309587A

United States Patent [19]

Fierro

[11] Patent Number: 5,309,587

[45] Date of Patent: * May 10, 1994

[54] INDUSTRIAL RAG CLEANING PROCESS

[76] Inventor: James V. Fierro, 9626 Ronbet Dr., Loveland, Ohio 45140

[ * ] Notice: The portion of the term of this patent subsequent to Jun. 29, 2010 has been disclaimed.

[21] Appl. No.: 83,356

[22] Filed: Jun. 28, 1993

Related U.S. Application Data

[63] Continuation-in-part of Ser. No. 822,531, Jan. 17, 1992, Pat. No. 5,222,267.

[51] Int. Cl.[5] ..... D06F 43/02

[52] U.S. Cl. ..... 8/158; 8/142; 34/499; 68/18 R

[58] Field of Search ..... 8/142, 158; 68/18 R; 34/27, 28, 32, 33, 76, 77, 79

[56] References Cited

U.S. PATENT DOCUMENTS

| | | | |
|---|---|---|---|
| 3,577,215 | 2/1969 | Impullitti | 8/142 |
| 3,600,911 | 8/1971 | McLegan | 68/18 C |
| 3,635,656 | 1/1972 | Piepmeyer | 8/142 |
| 3,689,211 | 9/1972 | Giampalmi | 8/142 |
| 4,045,174 | 8/1977 | Fiihring | 8/142 |
| 4,483,160 | 11/1984 | Jost | 68/18 C |
| 4,781,041 | 11/1988 | Fowler | 68/18 R X |
| 5,222,267 | 6/1993 | Fierro | 8/158 |

*Primary Examiner*—Philip R. Coe
*Attorney, Agent, or Firm*—Charles R. Wilson

[57] ABSTRACT

A cleaning process for industrial rags to remove petroleum-based solvents in an environmentally safe manner comprises a series of steps. The industrial rags are initially subjected to high speed forces in a rotary drum to physically extract liquid solvent. The high speed extraction step is conducted while preferably maintaining a temperature within the drum of below the flash point of the petroleum-based solvent. Next, the rags are tumbled while being subjected to intermittent forced blasts of cold air and hot air to vaporize solvent remaining in the rags. The vapors are routed from the drum and condensed. The extracted liquid solvent and condensed solvent vapors are both routed to a waste solvent collection line. The industrial rags are finally dried to produce clean rags suitable for reuse.

9 Claims, 1 Drawing Sheet

INDUSTRIAL RAG CLEANING PROCESS

This is a continuation-in-part of "Industrial Rag Cleaning Process For The Environmentally Safe Removal Of Petroleum-Based Solvents", Ser. No. 07/822,531, filed Jan. 17, 1992, now U.S. Pat. No. 5,222,267.

This invention relates to a cleaning process for industrial rags. For particularly, the invention relates to a dry cleaning process for the environmentally safe removal of petroleum-based solvent from industrial rags.

Rags are used extensively in certain industries. For instance, the automotive industry uses rags for cleaning purposes on its assembly lines. The rags are often solvent-laden to aid in the removal of oil, grease, caulking and other petroleum-based solvent-soluble materials. A significant number of rags are consumed on a daily basis at such assembly lines when operating. Other industries also use significant quantities of rags for cleaning and other purposes.

Used rags can be simply thrown away. However, economics dictate that the rags be periodically cleaned and reused. Additionally, unless special procedures are used it is no longer acceptable to dispose of rags laden with certain contaminates, including many petroleum-based solvents typically found on industrial rags. In fact, there are companies whose primary line of business is to clean industrial rags for reuse. The rags must be cleaned efficiently to cost justify the process as well as cleaned in an environmentally safe manner. The economical and the environmental aspects of cleaning industrial rags have proved challenging.

In the past, most industrial rags were cleaned by a dry cleaning or water washing process. The rags were loaded in a perforated drum along with a dry cleaning solvent such as the commonly used perchloroethylene. The dry cleaning solvent has a solvency strength sufficient to dissolve oil, grease and other petroleum-based materials, solid or liquid. The dissolving process is assisted by agitation caused when the perforated drum is rotated. A second and a third cycle are often used to thoroughly clean the rags. Used dry cleaning solvent is normally filtered to remove solid soil particles and then distilled to remove soluble containments. Unfortunately, certain petroleum-based solvent containments are difficult to separate from the dry cleaning solvent because of close boiling points. Further, trace amounts of the petroleum-based solvent left in the rags must still be removed without contaminating the ground water supply or the air.

In accord with a demonstrated need, there has now been developed a process for cleaning industrial rags to remove environmentally unsafe petroleum-based solvents. The process is economical and environmentally safe.

SUMMARY OF THE INVENTION

A process for cleaning industrial rags contaminated with petroleum-based solvent comprises a series of steps. Initially, the rags are placed in a rotary drum of a dry cleaning machine. The drum is preferably maintained at a temperature below the flash point of the petroleum-based solvent. The rags are first subjected at high speeds to physically remove liquid petroleum-based solvent. The removed liquid solvent is drained from the rotary drum and routed to a waste solvent disposal collection line. Next, the rags are tumbled in the drum, while maintaining a temperature in the drum below the flash point of the petroleum-based solvent. Cold air and hot air are intermittently forced through the drum to vaporize the solvent. The vaporized solvent is forced from the rotary drum to a condenser where it is condensed and then routed to a waste solvent disposal collection line. The rags are cleaned to a state satisfactory for reuse.

DETAILED DESCRIPTION OF THE INVENTION

Figure 1:
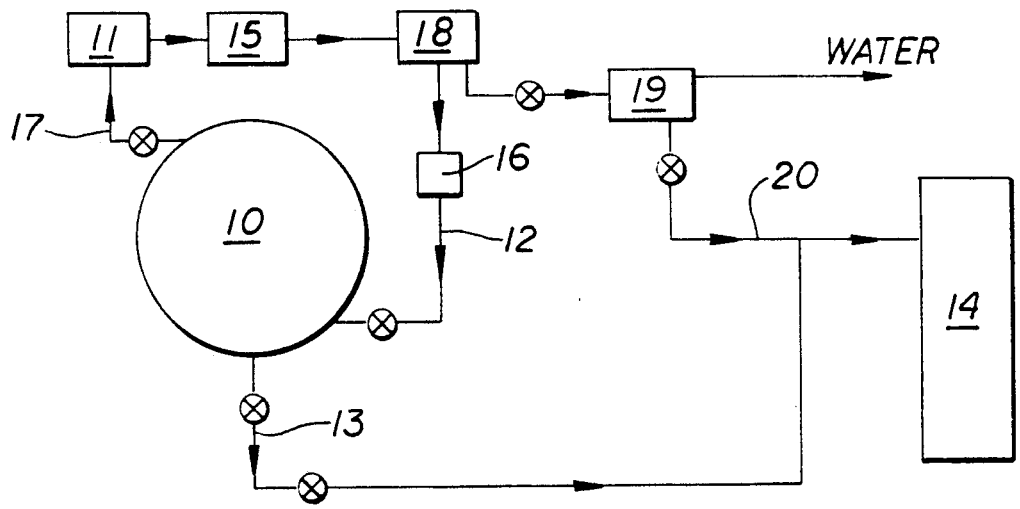
FIG. 1 is a schematic block diagram of the cleaning process of the invention.

The cleaning process of the invention comprises a series of steps. Each step of the process is described in detail in the following paragraphs. While the process is particularly suited for the cleaning of industrial rags contaminated with environmentally unsafe petroleum-based solvents, it should be understood the process is useful for the cleaning of all types of fabrics soiled with all types of petroleum-based solvents. Examples of environmentally unsafe petroleum-based solvents include mineral spirits, toluene, xylene and methyl ethyl keytone. Mineral spirits in particular is widely used in industry for cleaning purposes and the process of the invention is uniquely adapted for the cleaning of rags contaminated with mineral spirits.

Industrial rags cleaned in the process of the invention are received in batches of several pounds. The rags are contaminated normally with a known petroleum-based solvent having a known flash point. If not known, routine experimentation will determine the flash point. As discussed below, certain steps of the process are run at temperatures below the petroleum-based solvent's flash point, thus the reason for making the flash point determination.

The industrial rags are subjected to several process steps in the rotary drum of a dry cleaning machine. Machines of this general nature are well known and can be used in the process of the invention after various equipment modifications as discussed below. The machines have a mechanically driven rotary drum with variable speed controls which allows the drum to rotate at a slow speed to give its contents a tumbling action or to rotate at a fast speed to subject its contents to centrifugal forces. The drums have capacities ranging from about 80 pounds to about 150 pounds. Typically, the drum is lined with a screen or a perforated liner shell which retains the rags in the center of the drum. The screen or perforated liner allows the liquids in the process to contact the rags during a tumbling action for cleaning purposes, yet be separated from the rags during a centrifuging action for removal purposes.

The dry cleaning machine used in the process of this invention is equipped with cooling and heating units for controlling the temperature within the rotary drum. Units for accomplishing these purposes are well known. The units can have blower fans for forcing cooled or warmed air, respectively into the drum and variable temperature controls. Alternatively, a blower fan can be installed in-line to draw gaseous material through the cooling and/or heating units. The units are operatively connected to the dry cleaning machine so that the temperature controlled air is routed into the rotary drum.

A condenser unit and optionally a separator unit are also operatively connected with the dry cleaning machine to receive the forced air and any vaporized solvents from the rotary drum. Various valving and piping is used as described below and in FIG. 1 to conduct the process of the invention.

In accord with the process of the invention, the temperature within the rotary drum is preferably first reduced to below the flash point of the petroleum-based solvent contaminate found in the rags to be cleaned. The reduced temperature significantly lessens the chances for an explosion in the drum and, for this reason, is highly preferred. Preferably, the temperature within the drum is reduced at least ten fahrenheit degrees and more preferably, is reduced from about ten to about twenty fahrenheit degrees below the solvent's flash point. Conducting the liquid extraction step of the process at the reduced temperature also increases the amount of liquid solvent removed from the industrial rags and consequently reduces time needed in a subsequent vaporization step of the process.

Once the rotary drum is loaded with the rags, it is revolved at a high speed sufficient to physically extract liquid petroleum-based solvent from the rags. A speed of from about 750 rpm to about 1000 rpm creates centrifugal forces in the drum to cause the liquid to be expelled from the rags and forced through the screen or perforations. About two minutes to about five minutes of high speed extraction is generally sufficient to force most of the liquid from the rags. As the drum slows down, the liquid solvent begins to collect in the bottom of the drum. The liquid is ultimately drained from the drum via valving and piping and directed to a waste solvent disposal line. As aforementioned, while not necessary, maintaining the temperature in the rotary drum below the flash point of the solvent does allow an optimum removal of liquid petroleum-based solvent during this step of the process.

The rags remaining in the drum are thus substantially freed of liquid petroleum-based solvent. The next step of the process primarily removes petroleum-based solvent from the rags by vaporization. In this vaporization step, the ambient temperature within the rotary drum must be continuously maintained at below the flash point of the petroleum-based solvent. Preferably, the temperature is maintained at least ten fahrenheit degrees, more preferably, about ten to about twenty fahrenheit degrees below the solvent's flash point. The cooling unit, operatively connected to the drum, initially reduces the drum's ambient temperature by forcing air cooled to a temperature below the flash point of the petroleum-based solvent into the drum.

During the vaporization removal step of the process, cold air and hot air are intermittently forced into the drum to vaporize the petroleum-based solvent. The industrial rags are thus subjected to blasts of cold air and hot air while tumbling in the drum. For this purpose, a blast of air can last up to about fifteen seconds, followed almost immediately by a blast of air cooled or warmed to the opposite extreme for up to about fifteen seconds. During a given cycle, there are from about seventy-five to about one hundred different blasts of cold air with an about equal number of blasts of hot air, alternating with the other. The cooled air has a temperature below the flash point of the petroleum-based solvent, preferably at least ten fahrenheit degrees below the flash point, while the hot air has a temperature above the flash point, preferably from about ten to about one hundred fahrenheit degrees thereabove. Preferably, the desired temperature in the rotary drum is automatically maintained using known temperature control instrumentation.

The rotary drum is revolved at about forth rpm to about one hundred rpm during the vaporization removal step. A higher or slower drum rotation can be used, though optimum results in terms of processing time are achieved with the aforesaid operating range. Preferably, the drum is periodically stopped and revolved in an opposite direction to ensure that all the rags are tumbled. All the while the ambient temperature within the drum is maintained at the reduced temperature. It is theorized the solvent is driven from the rags by a vaporization action of the hot air and at the same time by an saturation capacity reduction effect of the cold air.

The drum is also equipped with valving and piping to direct the temperature controlled air and vaporized solvent from the drum to a condenser. The condenser condenses the vaporized solvent flowing through it and directs the liquid to a waste solvent disposal line. A separator is optionally used to receive the condensed solvent and separate it from any water which may have entered the system. Air exiting the condenser is preferably again routed through the rotary drum to conserve energy.

This step of the process is continued until substantially all the solvent has been removed. Generally, about thirty minutes to about sixty minutes is needed to remove substantially all remaining petroleum-based solvent in this vaporization removal step.

The condensed solvent removed in the vaporization step of the process is disposed in an environmentally safe manner. The solvent is routed separately or combined with the solvent from the liquid extraction step of the process and routed together to a waste solvent holding tank.

The industrial rags in the drum at this stage of the process are essentially petroleum-based solvent-free. Only trace amounts of residual solvent remain. The trace amounts as well as any remaining soil can be removed by conventional dry cleaning steps using a dry cleaning solvent and/or conventional water washing steps. These added steps are dependent on the types of soil remaining in the rags and the degree of cleaning needed. They do add to the cost of the cleaning process and are avoided if possible. In effect, the process of the invention as above described adequately cleans most industrial rags contaminated with the environmentally unsafe petroleum-based solvent.

The operation of the process is further understood with reference to FIG. 1. The air within the rotary drum 10 is first cooled by the cooling unit 11 to below the petroleum-based solvent's flash point in a preferred embodiment of the invention. Cold air from the unit 11 is directed into the drum 10 through piping 12. Next, the industrial rags are loaded into the drum 10. The rags are subjected to a high speed liquid extraction step by revolving the drum at a speed sufficient to cause liquid solvent to be expelled from the rags. The drum is slowed and the expelled liquid petroleum-based solvent drained through piping 13 to the waste solvent holding tank 14. Any remaining petroleum-based solvent in the rags is next driven by vaporization from the rags while remaining in the rotary drum. The drum is maintained at a temperature below the solvent's flash point in this step. Intermittent blasts of cold air from the cooling unit 11 and hot air from the heating unit 15 are routed by a fan 16 to the rotary drum 10. As depicted, the cooling and heating units are placed in-line. It should be understood, the heating unit is cycled off when the cold air is directed through it from the cooling unit, preferably by automatic instrumentation. Air and vaporized solvent exits the drum 10 through the piping 17. The air and vaporized solvent is routed through the condenser 18 and optionally the separator 19 to condense out and separate the liquid petroleum-based solvent. The solvent is then routed through the piping 20 to the waste solvent holding tank 14.

While the process of the invention has been described in particularity and with reference to the drawing, it should be understood various modification can be made. All modifications of an obvious nature are considered within the scope of the following claims.

I claim:

1. A process for the cleaning of industrial rags contaminated with environmentally unsafe petroleum-based solvent, comprising the steps of:

(a) placing a load of the industrial rags in a mechanically-driven rotary drum;

(b) revolving the drum at a high speed sufficient to physically extract liquid petroleum-based solvent contaminate from the industrial rags;

(c) routing the extracted petroleum-based solvent contaminate from the rotary drum to a waste solvent collection line for environmentally safe disposal;

(d) revolving the rotary drum to cause a tumbling of the industrial rags while maintaining the temperature within the drum at below the flash point of the petroleum-based solvent;

(e) intermittently forcing cold air and hot air through the rotary drum to vaporize solvent from the industrial rags; and (f) routing the vaporized petroleum-based solvent contaminant from the rotary drum to a condenser wherein the petroleum-based solvent contaminate is condensed and thereafter further routing said condensed solvent to a waste collection line for environmentally safe disposal.

2. The process of claim 1 wherein the temperature within the rotary drum during the liquid petroleum-based solvent extraction step is maintained at a temperature below the flash point of the petroleum-based solvent.

3. The process of claim 2 wherein the temperature within the rotary drum during the liquid petroleum-based solvent extraction step is maintained at least ten fahrenheit degrees below the flash point of the petroleum-based solvent.

4. The process of claim 2 wherein the temperature within the rotary drum during the solvent vaporization step is maintained at least ten fahrenheit degrees below the flash point of the petroleum-based solvent.

5. The process of claim 4 wherein the temperature within the rotary drum during the solvent vaporization step is maintained at from about ten to about twenty fahrenheit degrees below the flash point of the petroleum-based solvent.

6. The process of claim 4 wherein the blasts of cold air have a temperature at least ten fahrenheit degrees below the flash point of the petroleum-based solvent and the blasts of hot air have a temperature of about ten to about one hundred fahrenheit degrees about the flash point of the petroleum-based solvent.

7. The process of claim 2 wherein the rotary drum is revolved at about 750 rpm to about 1000 rpm for about two minutes to about five minutes during the liquid solvent extraction step.

8. The process of claim 7 further wherein the rotary drum is rotated at about forty rpm to about one hundred rpm for about thirty minutes to about sixty minutes during the solvent vaporization step.

9. The process of claim 8 wherein the petroleum-based solvent is mineral spirits.

* * * * *